US006983932B2

(12) United States Patent
Denny

(10) Patent No.: US 6,983,932 B2
(45) Date of Patent: Jan. 10, 2006

(54) METHOD OF MANUFACTURING A BOOKLET WITH PROTECTIVE COVERS

(75) Inventor: Barry Denny, Bury St. Edmunds (GB)

(73) Assignee: Denny Bros. Ltd., Suffolk (GB)

( * ) Notice: Subject to any disclaimer, the term of this patent is extended or adjusted under 35 U.S.C. 154(b) by 0 days.

(21) Appl. No.: 10/416,001

(22) PCT Filed: Nov. 8, 2001

(86) PCT No.: PCT/GB01/04960

§ 371 (c)(1),
(2), (4) Date: Jul. 25, 2003

(87) PCT Pub. No.: WO02/38388

PCT Pub. Date: May 16, 2002

(65) Prior Publication Data

US 2005/0098934 A1 May 12, 2005

(30) Foreign Application Priority Data

Nov. 7, 2000 (GB) ..... 0027213

(51) Int. Cl.
*B42D 1/00* (2006.01)

(52) U.S. Cl. ..... 270/52.09; 270/37; 428/41.7; 428/40.1; 281/18; 281/20

(58) Field of Classification Search ..... 270/52.07, 270/37; 428/40.1, 41.7; 281/20, 18
See application file for complete search history.

(56) References Cited

U.S. PATENT DOCUMENTS

| | | | | |
|---|---|---|---|---|
| 3,505,140 A | | 4/1970 | Dunn | |
| 3,866,900 A | * | 2/1975 | Kebba | 270/5.01 |
| 4,046,366 A | * | 9/1977 | McCain et al. | 270/21.1 |
| 5,830,550 A | * | 11/1998 | Treleaven et al. | 428/40.1 |
| 6,500,293 B1 | * | 12/2002 | Dexter | 156/264 |

FOREIGN PATENT DOCUMENTS

| | | |
|---|---|---|
| DE | 2 112 886 | 9/1972 |
| DE | 295 04 981.2 | 6/1995 |
| EP | 0 288 472 | 6/1991 |

* cited by examiner

*Primary Examiner*—Patrick Mackey
(74) *Attorney, Agent, or Firm*—Wenderoth, Lind & Ponack, L.L.P.

(57) ABSTRACT

A booklet has front and back protective covers between which is sandwiched a printed folded sheet. The folded sheet consists of a series of panels that are folded one over another in turn and are then folded together in half about at least one fold line orthogonal to the folding of the individual panels. With this booklet, its overall dimensions when folded can be kept small, for example, credit card size whereas the printable area of the inner folded sheet is much larger. Moreover, the structure of the booklet is one suitable for in-line production.

15 Claims, 6 Drawing Sheets

METHOD OF MANUFACTURING A BOOKLET WITH PROTECTIVE COVERS

FIELD OF THE INVENTION

The present invention relates to booklets and to an automated method of making the same. In particular, but not exclusively, the present invention relates to smaller booklets suitable for carrying around in a pocket, such as credit card sized booklets, but that are capable of presenting a large amount of information.

BACKGROUND OF THE INVENTION

Printed paper has always been folded, for convenience, to reduce the area of its main surface, for example maps. However, simply folding a sheet of paper leaves it unprotected to the effects of wear and tear and the edges in particular can, over time, become tom. In EP0288472 a sheet is described which has concertina folds and which includes stiffened portions at diagonally opposed corners of the sheet. The stiffened portions form front and back covers to the folded sheet, thereby affording the folded sheet some protection. The stiffened portions are described as being magnetised in order to ensure that the folded sheet can be held closed. EP0288472 omits any explanation as to how such a booklet could, in practice, be manufactured.

In U.S. Pat. No. 3,505,140 a card-like article is described which consists of front and back transparent protective sheets between which a card-like article may be interposed and secured as the inner surfaces of both of the transparent sheets bear a pressure sensitive adhesive. With this arrangement the article is fixed once it has been placed between the protective outer sheets. Thus, this arrangement provides no opportunity for the article to be folded. Instead the area of the printed surface of the article is limited by the surface area of the protective sheets. U.S. Pat. No. 3,505,140 also fails to provide any explanation of how the card-like article and the protective cover sheets could, in practice, be manufactured.

In DE2112886 an in-line method of manufacturing self-adhesive address labels is described in which a paper label sheet is adhered to a layer of adhesive supported by a web of silicon coated material. The width of the paper label sheet, in a direction orthogonal to the direction of movement of the web, is less than the width of the web so that an edge portion of the adhesive layer is left exposed. Individual labels are then cut out from the paper label sheet and the waste paper removed carrying with it unwanted adhesive surrounding each of the cut labels. A web of paper is then applied over the top of the individual labels, the exposed adhesive and the web of silicon material. The webs are then cut through to form individual adhesive labels sandwiched between opposing outer protective sheets that are secured together along one edge. Whilst this document provides a description of one method of manufacturing individual labels, the individual labels are restricted in size to the dimensions of the outer protective layers.

SUMMARY OF THE INVENTION

The present invention seeks to provide an improved booklet and a method of manufacturing the same.

The present invention provides a booklet manufacturing method comprising the following steps: providing first and second webs of protective material; introducing between the first and second webs of protective material a series of intermediate booklets; and cutting through at least the first and second webs of protective material to form individual booklets, characterised in that the intermediate booklets each comprise a sheet having at least one fold and during the cutting step the intermediate booklet is cut so as to separate the fold from the intermediate booklet.

In a further aspect the present invention provides a booklet comprising front and back protective covers and at least one sheet therebetween, the front and back covers being adhered to one another along one edge and the sheet being folded such that in its unfolded state the surface area of the sheet is greater than the surface area of either the front or back protective covers.

The present invention also provides a booklet when manufactured by the method described above.

With the present invention a booklet from an automated manufacturing procedure can provide greater surface for print than the surface area of the booklet when closed. The booklet and the method of manufacturing the booklet are particularly suited to booklets intended to be of approximately credit card size.

Reference is made herein to the transverse edges of the booklet. These are the edges of the booklet that lie generally orthogonal to the direction in which the booklet is opened whereas the longitudinal edges of the booklet lie substantially parallel to the direction in which the booklet is opened, subject, of course, to the particular shape of an individual booklet.

BRIEF DESCRIPTION OF THE DRAWINGS

Embodiments of the present invention will now be described by way of example with reference to the accompanying drawings, in which.

DETAILED DESCRIPTION OF THE INVENTION

Figure 1:
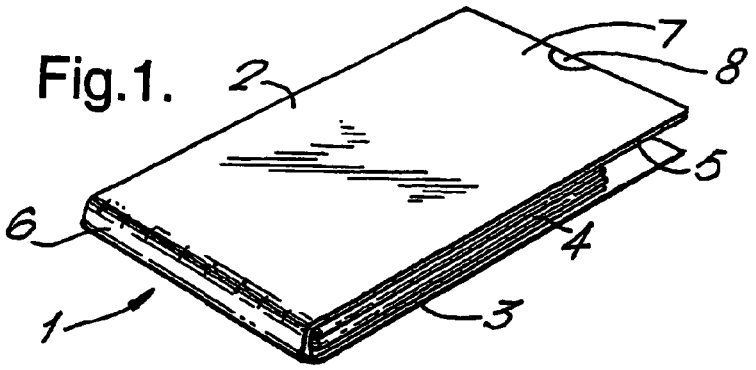
FIG. 1 is a perspective illustration of a first booklet in accordance with the present invention in a closed configuration.

The booklet 1 of FIG. 1 includes respective front and back protective covers 2, 3 between which is sandwiched a folded sheet 4 at east one side of which is printed. The front protective cover 2 has a layer of adhesive 5 on its inner surface to which a portion of the folded sheet is adhered. The adhesive 5 also secures the back cover 3 to the front cover 2 along one edge 6 that forms the spine of the booklet 1. The portion of the folded sheet, which is adhered to the front cover, extends to the periphery of the front protective sheet along three edges, the fourth edge being the edge where the front and back protective sheets are adhered to one another. At the edge 7, which is opposite to the edge 6 where the front and back sheets are secured, the portion of the folded sheet which is adhered to the front sheet includes a cut-out 8 which exposes the adhesive on the inner surface of the front sheet-2. As can be seen in FIG. 1, the folds of the sheet 4 are positioned inwards from the edge 7 of the front sheet. In this way the cut-out 8 defines an aperture through which the front and back sheets are adhered together.

The protective covers 2, 3 are preferably of a plastics material, for example polyester, polypropylene or vinyl. The front and back covers may also be printed but are preferably transparent. The sheet 4, on the other hand, is preferably of paper or any other material that is suitable for printing or writing upon and is capable of being folded. The layer of adhesive 5 is preferably a pressure sensitive adhesive such as an aqueous acrylic that is also preferably transparent. This adhesive provides a substantially permanent adhesion between the folded sheet 4 and the front cover sheet 2 but a resealable adhesion between the front and back cover sheets 2, 3, because of the different characteristics of the materials with which it is in contact. This enables the front and back sheets to be separated, where they adhere to one another at the cut-out 8, to open the booklet 1 and they can then be re-adhered to close the booklet on subsequent occasions.

Figure 2:
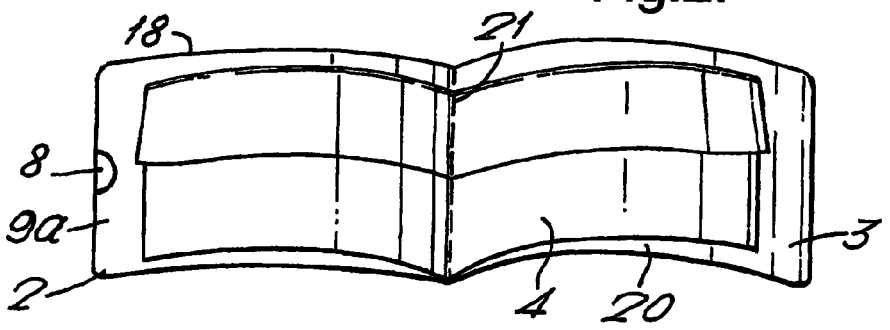
FIG. 2 shows the booklet of FIG. 1 partially opened.
Figure 3:
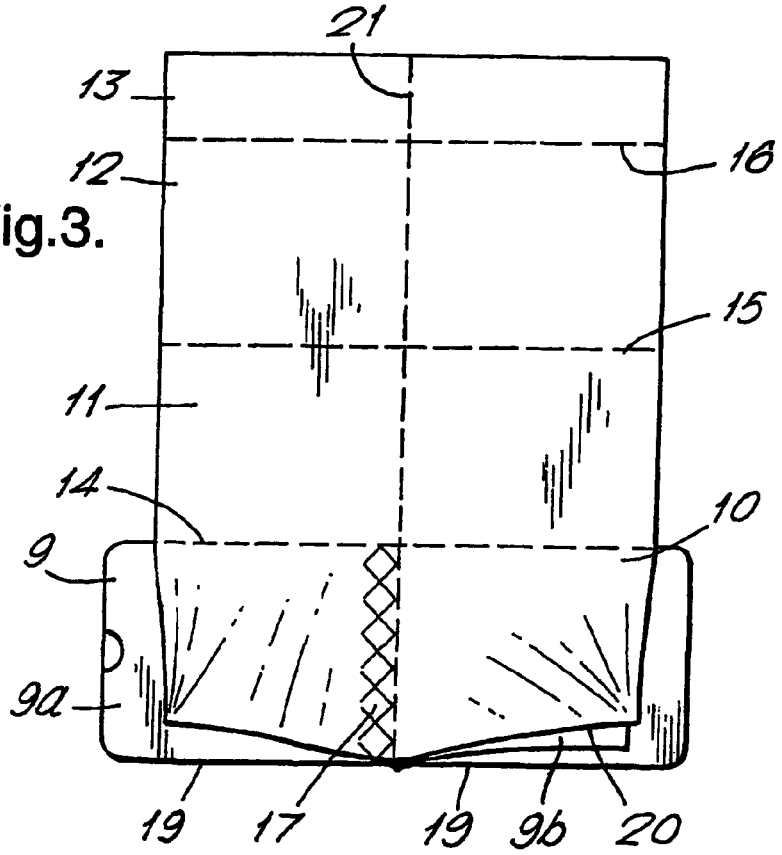
FIG. 3 shows the booklet of FIG. 1 fully opened.

As is more clearly seen in FIGS. 2 and 3, the folded sheet 4 consists of a series of panels that are folded one over the other in turn (in a z-fold) and then are together folded in half in a direction orthogonal to the folding of the individual panels. The fold lines are indicated in the figures by dotted lines. The folded sheet illustrated in FIGS. 1–3 consists of five panels 9, 10, 11, 12 and 13, with panel 9 being the outermost panel, enclosing the other panels, when the sheet 4 is in its folded state. The first panel 9 has a greater width, parallel to the spine 6 of the booklet, than the remaining panels as the first panel extends the entire width of the front cover sheet 2, between opposing longitudinal edges of the cover sheet. The width of the panels is described with reference to the width of the front sheet but the comparison is equally true for the back sheet 3. The second panel 10 has a slightly smaller width. It extends from one edge of the front cover sheet to its fold line 14 with the third panel at a position inward from the opposing longitudinal edge of the front sheet. The third and fourth panels 11, 12 are approximately equal in width, but smaller in width than the first and second panels, as their respective fold lines 14, 15, 16 are all positioned inward from the opposing longitudinal edges of the front cover sheet. The fifth panel 13 is smaller in width than all of the other panels and preferably has a width half of that of the first panel or even less.

The panels of the sheet 4 are folded in a zigzag so that the first panel forms the outermost panel and the fifth panel forms the innermost panel. As can be seen from FIG. 2, this results in the free edge of the fifth panel being approximately central to the booklet. This arrangement results in the free edge of the fifth panel being particularly easy to grasp when unfolding the sheet but also prevents accidental unfolding of the sheet 4 because the free edge of the fifth panel is distant from the edges of the front and back sheets. This ensures that the free edge of the fifth panel cannot easily be caught and pulled when the booklet is in its closed configuration.

The first and second panels 9 and 10 are secured together by a line of adhesive 17. To assist in an understanding of the structure of the booklet, the line of adhesive is indicated in FIG. 3 by a line of cross-hatching. In practice the second panel 10 would obscure the view of the line of adhesive in FIG. 3 as the adhesive is on the surface of the second panel 10 facing into the Figure.

The fold line between the first and second panels 9 and 10 is not illustrated in FIG. 2 or 3. This is because the fold line is removed during manufacture of the booklet 1. The first panel 9 therefore has opposing free longitudinal edges 18 and 19 and the second panel 10 has a free longitudinal edge 20 and an opposing fold line 14 with the third panel 11. Thus, in the booklet 1, the folded sheet 4 is separated into two parts with the first part being the first panel 9 which is secured to the second part, comprising the remaining panels of the sheet, by the line of adhesive 17.

As was described earlier the sheet 4 is also folded in a direction perpendicular to the fold lines between the individual sheets. This transverse fold line 21, which lies parallel to the edge region 6 where the front and back protective-sheets are secured together, divides each panel into two sections. In the case of the first panel 9, the first panel section 9*a* is that portion of the folded sheet that is adhered to the front sheet 2. The second panel section 9*b* is adjacent the back protective sheet 3 of the booklet but need not be directly adhered thereto.

With the booklet described above a large amount of information can be printed onto the folded sheet 4. The sheet 4 is then folded for storage into a conveniently small size, for example credit card size. Moreover, the adhesion of the front protective sheet 2 to the back protective sheet 3 via the cut-out 8 ensures that the booklet 1 is held closed until it is desired to open the booklet and that the booklet can be opened and re-secured in a closed configuration repeatedly.

Figure 4:
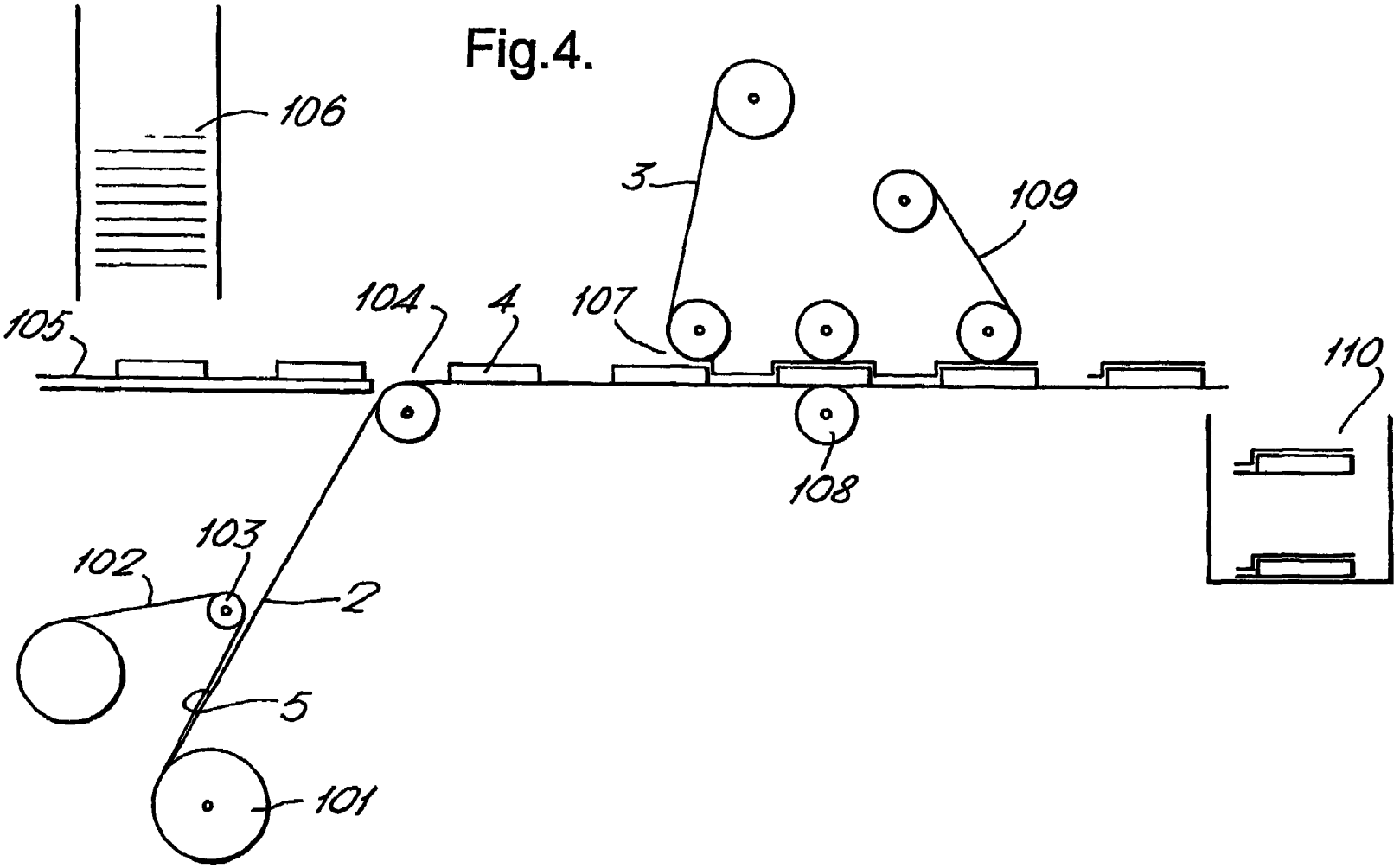
FIG. 4 is a diagram of an apparatus for the manufacture of the booklet of FIGS. 1 to 3 in accordance with the present invention.

FIG. 4 illustrates an apparatus for the automated manufacture of the booklet described above with reference to FIGS. 1-3 in which the booklet can be manufactured in-line with all of the elements and features of the booklet being brought together in a single automated manufacturing procedure. Stock material is supplied on a roll 101 as a web and comprises a web of plastics material that is to be used to form the front cover sheet 2, a layer of adhesive 5 and a release layer 102 which covers the adhesive layer and which may be a paper or plastics material having a waxed or siliconised surface facing the adhesive layer 5. The stock material is unrolled and has the release layer removed 103 as waste material. The web of plastics material thus supports an exposed layer of adhesive uppermost as it travels from the station where the release material is removed to an intermediate booklet applying station 104.

At the intermediate booklet applying station 104 individual intermediate booklets 4, in the form of folded sheets, are applied individually to the exposed adhesive 5. The folded sheets 4 are applied to the layer of adhesive 5 downwardly with the front face 9*a* of the folded sheet facing towards the adhesive 5. The intermediate booklets 4 are delivered to the applying station 104 by means of a conventional conveyor 105 and may be delivered to the conveyor 105 from a hopper 106, as illustrated. Alternatively, the automated folding of the sheets 4 and the delivery of the folded sheets to the applying station 104 can be integrated with the manufacture of the booklets 1.

The plastics material 2 with a sequential series of individual folded sheets 4 then travels to a web applying station 107 where a web of plastics material 3 is applied over the top of the layer 5 of adhesive material and the folded sheets. The plastics material 3 applied at this station 107 is similar to the web of plastics material 2 but has no adhesive layer. The combination of the lower web of plastics material 2, the adhesive layer 5, the folded sheets 4 and the upper web of plastics material 3 then travels to a die-cutting station 108 where individual booklets are die-cut from the webs and the waste 109 is removed. The die-cutters may be conventional rotary or flat-bed cutters and are arranged to cut through all layers passing therebetween to form individual booklets separated from one another on the conveyor. The individual booklets then travel to a collection hopper 110 where they are collected together for packaging and storage.

It is particularly convenient, but not essential, for the folded sheets 4 to be applied to the layer of adhesive with the fold line 23 facing towards the direction of travel. This reduces the risk of the booklet being inadvertently opened when the waste 109, surrounding each of the individual booklets, is removed. In this orientation, the longitudinal edges of the booklet lie substantially parallel to the direction of travel.

The delivery of the booklets to the adhesive layer can be monitored and controlled using conventional techniques. For example, a sensor (not shown) may be positioned upstream from the die-cutting station 108 to detect the leading edge of each intermediate booklet. The timing of the die-cutter is then adjusted to accommodate the time of travel of the intermediate booklet from the sensor to the die-cutting station. Alternatively, the delivery of the intermediate booklets to the layer of adhesive may be adjusted with respect to the timing of the die-cutting station 108.

Figure 5A:
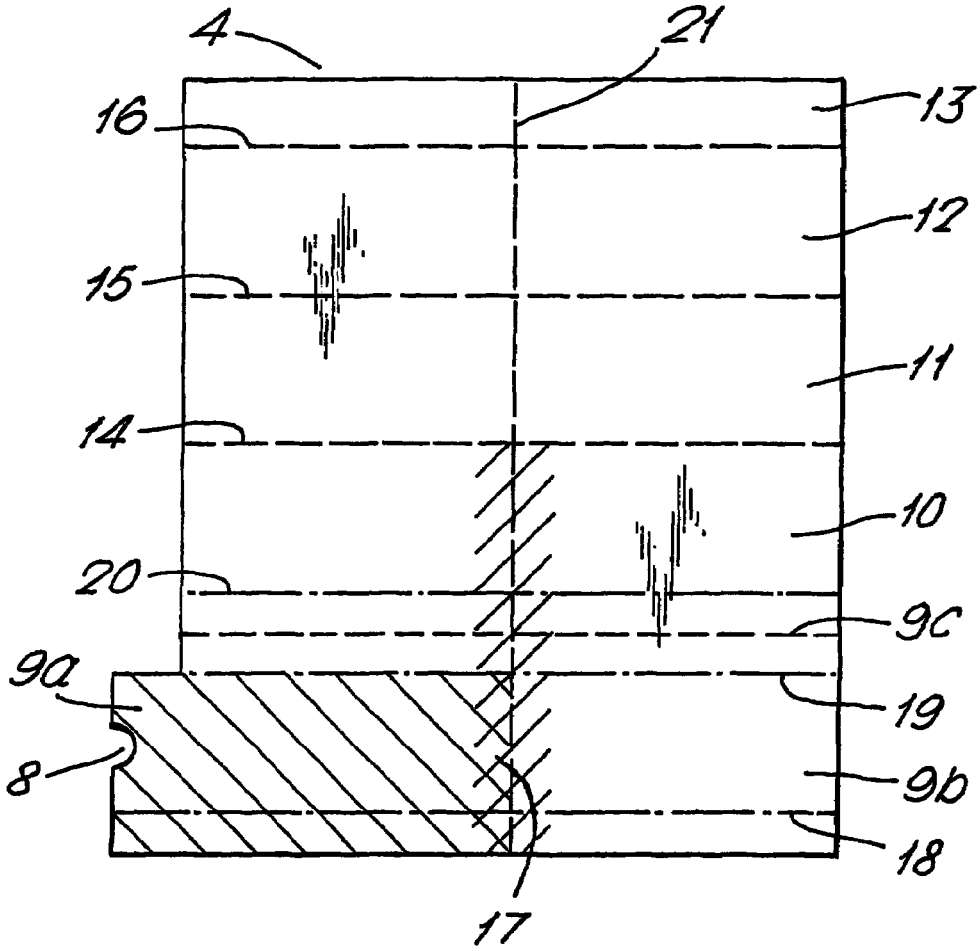
FIG. 5*a* illustrates a sheet before folding on which are marked fold lines and die-cutting lines.

As mentioned earlier it is envisaged that the intermediate booklets 4 be manufactured as part of the in-line process. In FIG. 5*a* a sheet 4 is illustrated showing the fold lines (as dotted lines) and the die-cut lines (as dot-dash lines) and in FIG. 5*b* a folded sheet sandwiched between upper and lower webs of plastics material is shown with the die-cutting lines marked in dot-dashed lines. The sheet 4 is initially be printed on one or both sides and has a line of adhesive 17 applied to the surface of the sheet facing into the Figure. The sheet 4 is then folded about the fold line 9*c* between the first panel 9 and the second panel 10 so that the line of adhesive 17 is enclosed within the two panels. Further folds are made about fold lines 14, 15 and 16 in turn so that the final panel 21 partially overlies the other panels of the sheet 4. A final fold about fold line 21 is then performed so that the folded sheet forms an intermediate booklet with the panel section 9*a* facing into the Figure. Once folded, the two dot-dash lines 19 and 20 should be aligned with one another to represent a single line of cutting, in-board from the fold line 9*c*. Also, as can be seen in FIG. 5*a*, the cut-out 8 is already present in the panel section 9*a*.

Figure 5B:
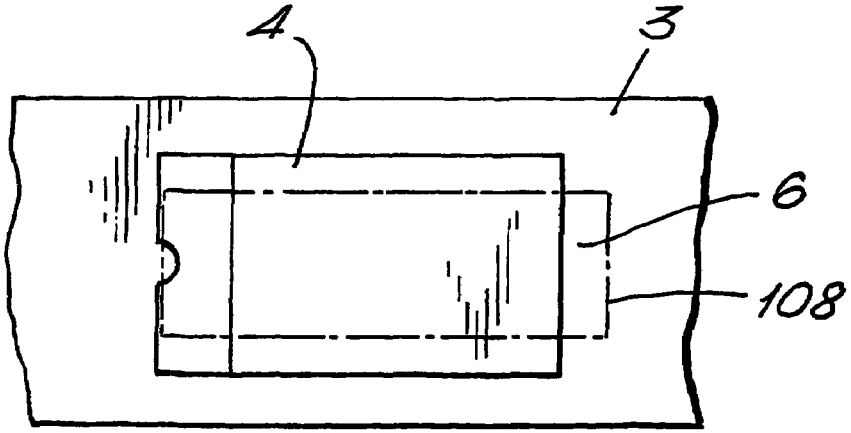
FIG. 5*b* illustrates the die-cutting lines to produce the booklet of FIGS. 1–3.

The surface of the panel section 9*a*, facing inwards in FIG. 5*b*, is the surface that is subsequently brought into contact with the layer of adhesive on the web of plastics material 2. Once the second web of plastics material is in place and the sandwiched layers of plastics material and folded sheet are brought to the die-cutting station 108 a booklet is cut from the combination of layers. This may be performed as a single cut or as a series of cuts. In FIG. 5*b* the cutting lines are indicated in dot-dash lines 108. Th dot-dash lines 18, 19 and 20 in FIG. 5*a* correspond to the two parallel cuts through both webs of plastic material and the folded sheet 4. The cuts produce co-terminus edges for both layers of plastic material, forming the front 2 and back 3 covers of the booklet, and for the folded sheet 4. A further cut is made through the two webs of plastic material and the end section of the first panel section 9*a*, adjacent the cut-out 8. A further cut, through only the two webs of plastic material, beyond the folded edge 21 of the sheet 4, forms the spine 6 of the booklet. All of these cuts may be performed sequentially or simultaneously.

Although the apparatus illustrated in FIGS. 4 and 5 uses stock material from which the release layer is removed, it is of course, possible for non-adhesive plastics material to be employed for the cover sheet 2 in which case the station 103 at which the release layer is removed is replaced by an adhesive applying station where adhesive is applied to the surface of the web of plastics material either in a continuous layer or in lines or other repeating patterns.

The booklet 1 may incorporate different folding arrangements, different widths for each of the panels of the folded sheet and other additional features for which further non-limiting examples are given below.

Figure 6:
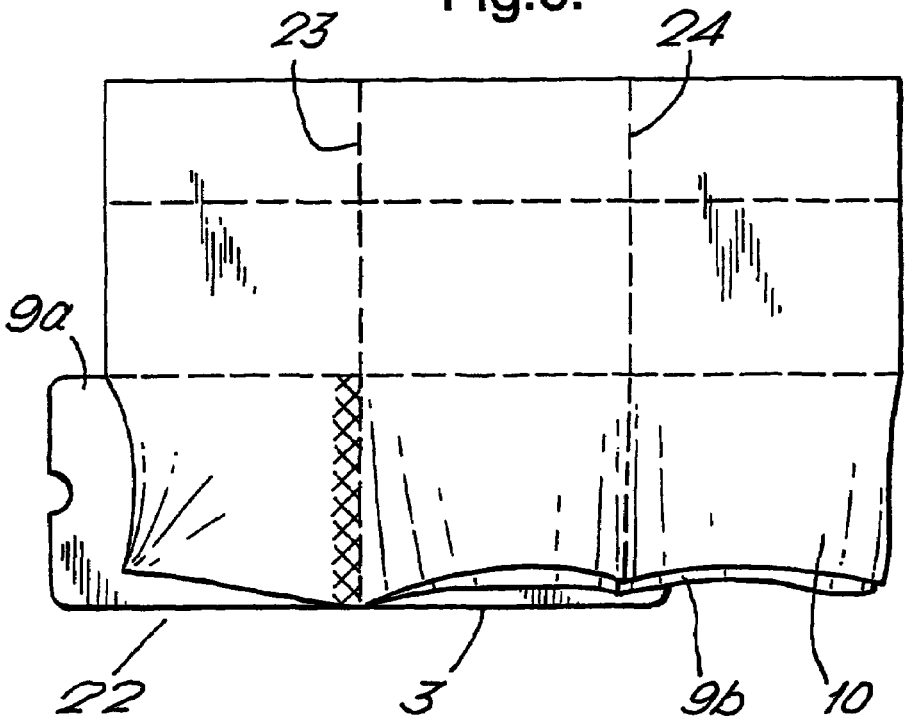
FIG. 6 illustrates a second booklet in an opened configuration, in accordance with the present invention.

In FIG. 6 a second booklet 22 is illustrated which is similar in construction to the booklet of FIGS. 1–3 and like reference numerals have been employed where appropriate. With this second booklet, the folded sheet 4 has two fold lines 23 and 24 that lie substantially parallel to the spine of the booklet, instead of the one fold line 21 in the first booklet. This results in an even larger sheet on which information may be printed. Also, the second panel section 9*b* of the first panel extends beyond the edge of the back protective sheet 3 when the booklet 22 is fully open. It may also be seen that with this second booklet, the number of panels is such that the last panel, being a half panel, extends upwards from the bottom edge of the booklet, rather than downwards from the top edge of the booklet as illustrated in FIGS. 1–3.

Figure 7:
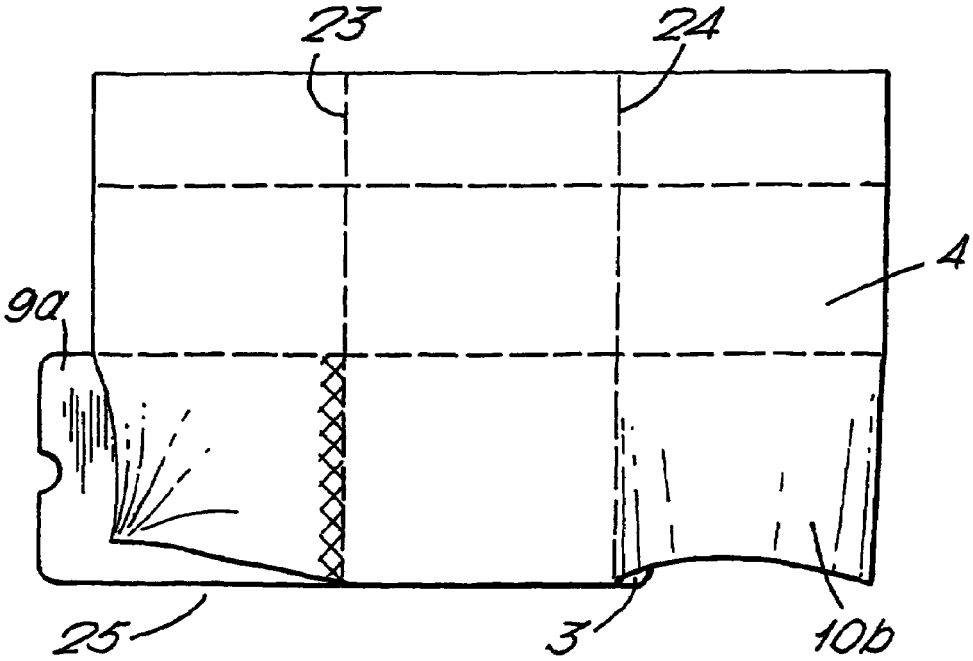
FIG. 7 illustrates a third booklet in an opened configuration, in accordance with the present invention.

In FIG. 7 a third booklet 25 is shown that is similar to the booklet illustrated in FIG. 6 in that each of the panels is divided into three sections by means of two transverse fold lines 23 and 24. With this third booklet, unlike the sheets of the first and second booklets which were folded from a substantially rectangular sheet, with the third booklet the first panel 9 of the sheet 4 is shorter in length than the remaining panels of the sheet and indeed the first panel 9 extends only to the first of the fold lines 23. This results in the second panel section of the first panel 9 being omitted and the second panel section 10*b* of the second panel lying immediately adjacent the back protective sheet 3.

Figure 8:
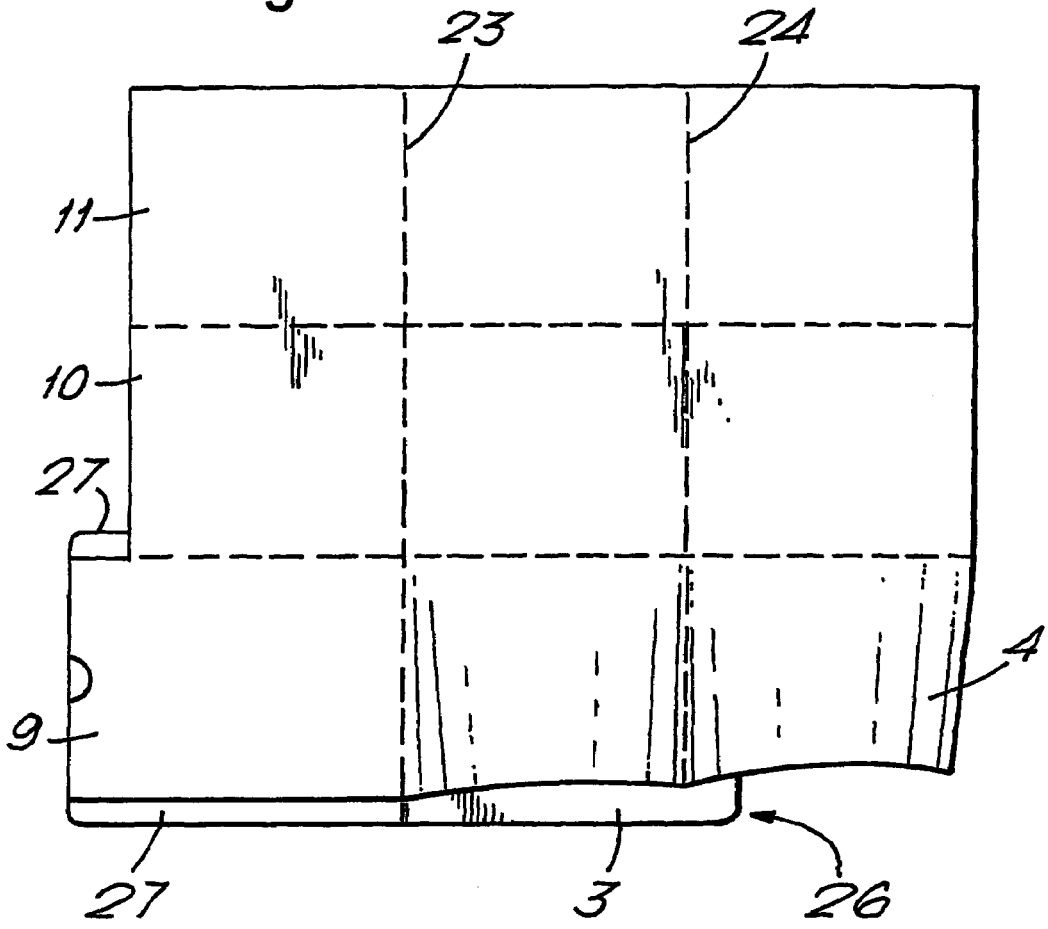
FIG. 8 illustrates a fourth booklet in accordance with the present invention.

The fourth booklet 26 illustrated in FIG. 8 generally comprises front and back protective covers 2, 3 and a folded sheet 4 which has two fold lines 14, 15 extending substantially parallel to the length of the booklet which divide the sheet into three panels 9, 10, 11. Each of the three panels has a width less than the width of the front and back protective covers 2, 3. Thus, the front and back covers have opposing margins 27 with extend beyond the folded edges of the sheet 4. Unlike the booklets illustrated in the previous figures, the fold line between the first and second panels is present so that the second panel can be folded out of an overlapping arrangement with respect to the first panel. Thus, the line of adhesive to be found in the previous embodiments is omitted in this fourth booklet. However, as before, the first panel section 9*a* is adhered to the front protective cover whilst the second panel section 9*b* lies immediately adjacent to but not adhered to the back protective cover 3.

When the fourth booklet is in its closed configuration, the folded sheet 4 lies within the periphery of the front and back protective covers 2, 3 with the folded sheet extending to the periphery at only one edge. Along the other three sides of the booklet the margins 27 of the front and back covers adhere to one another by means of the adhesive on the front protective cover to encapsulate the folded sheet.

Figure 9:
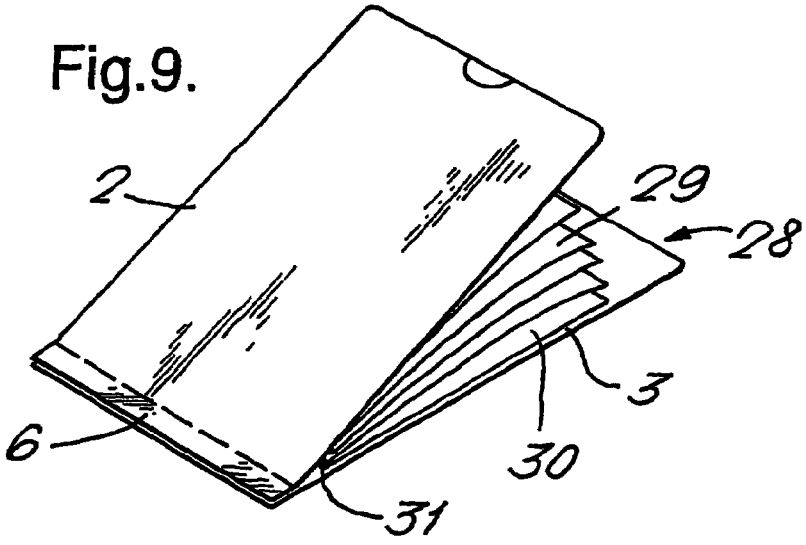
FIG. 9 illustrates a fifth booklet in accordance with the present invention, in an opened configuration.

Th fifth booklet 28 illustrated in FIG. 9 generally comprises front and back protective covers 2, 3 and a plurality of individual pages 29 on which information may be presented, the pages being secured together using any of the conventional means available including but not limited to mechanical means such as staples, sewing or adhesive. The front page 9 is adhered to the front protective cover and has a cut-out 8. The front page 9 extends to the edge of the front cover distant from the spine of the booklet 28, whereas the remaining pages of the booklet all stop short of the same edge of the front cover so that an edge portion of the back cover is left uncovered and is able to adhere to the front cover through the cut-out 8. The back page 30 is adhered to the back protective cover 3 by means of a line of adhesive 31 adjacent the spine of the booklet. Each of the pages 29 of the booklet has a width substantially equal to the width of the front and back covers. Preferably the pages 29 and the front and back covers have opposing co-terminus longitudinal edges. As for all of the booklets described herein the front and back protective covers 2, 3 adhere directly to one another by means of the layer of adhesive on the inner surface of the front cover sheet, along an edge region 6 which defines the spine of the booklet.

Figure 10:
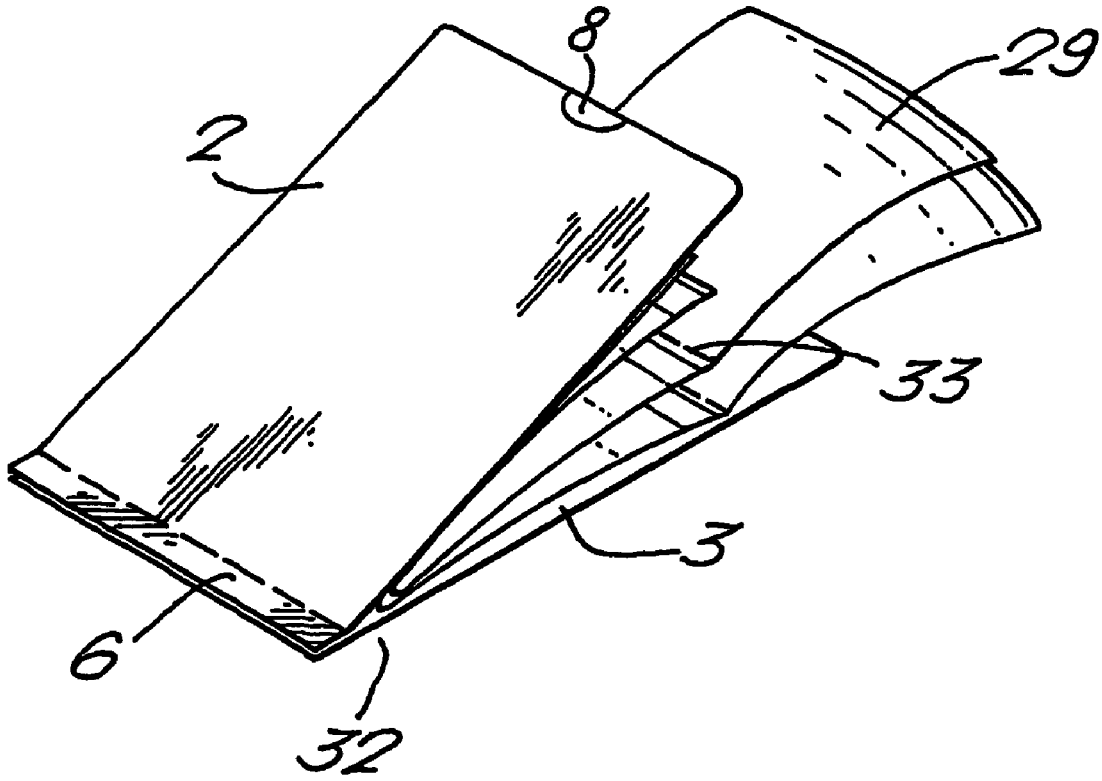
FIG. 10 illustrates a sixth booklet in accordance with the present invention, in an opened configuration.

The sixth booklet 32 is similar to the fifth booklet 28 in that the booklet includes a plurality of individual pages 29 and in that opposing longitudinal edges of each of the pages are co-terminus with the edges of the front and back protective covers 2, 3. With this sixth booklet, however, at least some of the pages are folded about a fold line 33 lying substantially parallel to the spine of the booklet such that in the open position the pages extend twice the length of the booklet when in its closed configuration. Although a single fold line is illustrated for each of the extended pages in FIG. 10, it will be appreciated that the pages may be further extend through the addition of extra fold lines.

In the embodiments of the booklets described above the panel section immediately adjacent the back protective sheet are not directly secured or adhered to the back protective sheet. It will, of course, be apparent that, if desired, adhesive could be applied to either that panel section or to the surface of the back protective sheet to secure the pan I section to the back protective sheet. Moreover, it is envisaged that perforations or tear lines may be included in the folded sheet and in particular to the extended pages to enable parts of the interior of the booklet to be removed, as desired. This is particularly beneficial where the booklet is intended to contain a plurality of coupons, tickets or pharmaceutical prescriptions.

In the manufacture of the booklet, to ensure a fully automated process, the sheet bearing the printed information is folded and has one or more of the fold lines removed in a die cutting operation. In the case of the fifth and sixth booklets 28 and 32 each of the longitudinal folded edges is severed from the panels during the die cutting step.

In the example given above, the booklet is constructed with the booklet facing downwards. However, in the alternative the intermediate booklet may be placed face up on a web of plastics material that is to form the back cover sheet 3 of the final booklet 1. Adhesive is then applied to the exposed upper surface of the folded sheet or the surface of a web of plastics material that is applied over the top of the folded sheet and the lower web of plastics material. The folded sheet or intermediate booklet may simply be placed on the lower web of plastics material or may be secured in position by means of adhesive. In a preferred manufacturing method the adhesive is located in the selvage edge regions of the folded sheet so that the adhesive between the back cover sheet 3 and the folded sheet is removed during the die-cutting step.

Furthermore, although in the manufacturing methods described above the front and back protective covers are formed from webs of plastics material, in an alternative one or both of the front and back covers may be in the form of as series of separate sheet elements to each of which a folded sheet is applied.

The booklet is suitable for many and varied applications, including but not limited to road and rail maps, address books, directories, diaries and calendars and listings and tables of useful information, medical and nutritional information, technical instructions etc.

What is claimed is:

1. A booklet manufacturing method comprising the following steps:

providing first and second webs of protective material;

introducing between the first and second webs of protective material a series of intermediate booklets; and cutting through at least the first and second webs of protective material to form individual booklets, wherein the intermediate booklets each comprise a sheet having at least one fold, and wherein, during the cutting step, each of the intermediate booklets is cut so as to separate the fold from therefrom.

2. A booklet manufacturing method as claimed in claim 1, wherein each of intermediate booklets comprises a sheet folded at least once in two substantially orthogonal directions.

3. A booklet manufacturing method as claimed in claim 1, wherein each of the intermediate booklets is adhered to at least one of the first and second webs of protective material.

4. A booklet manufacturing method as claimed in claim 1, wherein the first and second webs of protective material each comprise a series of individual sheet elements.

5. A booklet manufacturing method as claimed in claim 1, wherein the first and second webs of protective material each comprise a plastics material.

6. A booklet manufacturing method as claimed in claim 1, wherein the intermediate booklets are located sequentially on the first web of protective material and the second web of protective material is applied over the exposed surfaces of the intermediate booklets and the first web.

7. A booklet manufacturing method as claimed in claim 6, wherein the first web includes adhesive to which the intermediate booklets and the second web adheres.

8. A booklet manufacturing method as claimed in claim 1, wherein each of the intermediate booklets is formed in a single cut.

9. A booklet manufacturing method as claimed in claim 1, further comprising folding each of the sheets at least once to form the intermediate booklets prior to the intermediate booklets being located between the first and second webs.

10. A booklet manufacturing method as claimed in claim 9, wherein each of the sheets is folded at least once in two substantially orthogonal directions.

11. A booklet manufacturing method as claimed in claim 10, wherein each of the sheets is folded at least twice with at least one panel of the folded sheet having a greater width than the remaining panels.

12. A booklet manufacturing method as claimed in claim 11, wherein an outermost panel has the greatest width.

13. A booklet manufacturing method as claimed in claim 9, wherein each of the sheets is folded so as to have an innermost panel that terminates distant from the folded edge of the sheet.

14. A booklet manufacturing method as claimed in claim 1, wherein the booklet is cut to have a surface area substantially equal to that of a credit card.

15. A booklet manufactured by the method as claimed in claim 1.

* * * * *